US008390978B1

(12) United States Patent
Saliga

(10) Patent No.: US 8,390,978 B1
(45) Date of Patent: Mar. 5, 2013

(54) INCAPACITATION DEVICE AND METHOD WITH ASYNCHRONOUS T-WAVE AVOIDANCE

(76) Inventor: Thomas V Saliga, Tampa, FL (US)

( * ) Notice: Subject to any disclaimer, the term of this patent is extended or adjusted under 35 U.S.C. 154(b) by 208 days.

(21) Appl. No.: 13/007,605

(22) Filed: Jan. 15, 2011

Related U.S. Application Data

(60) Provisional application No. 61/297,248, filed on Jan. 21, 2010.

(51) Int. Cl.
*H01T 23/00* (2006.01)

(52) U.S. Cl. ..... 361/232

(58) Field of Classification Search ..... 361/232
See application file for complete search history.

(56) References Cited

U.S. PATENT DOCUMENTS

| | | | | |
|---|---|---|---|---|
| 2,896,123 | A * | 7/1959 | McNulty | 315/177 |
| 5,698,815 | A * | 12/1997 | Ragner | 102/502 |
| 6,898,887 | B1 | 5/2005 | Stratbucker | |
| 7,305,787 | B1 | 12/2007 | Stratbucker | |
| 7,602,597 | B2 * | 10/2009 | Smith et al. | 361/232 |
| 7,701,692 | B2 * | 4/2010 | Smith et al. | 361/232 |
| 7,778,005 | B2 | 8/2010 | Saliga | |
| 8,098,474 | B2 * | 1/2012 | Smith et al. | 361/232 |
| 8,107,213 | B2 * | 1/2012 | Smith | 361/232 |
| 2009/0020002 | A1 * | 1/2009 | Williams et al. | 89/41.03 |

* cited by examiner

*Primary Examiner* — Ronald W Leja
(74) *Attorney, Agent, or Firm* — David Kiewit

(57) ABSTRACT

An electric incapacitation device varies both the energy of output pulses and the time intervals between them, where all of the time intervals are longer than about 55 msec. The timing choices keep the output pulses from repeatedly coinciding with the T-wave portion of a targeted person's cardiac waveform. This reduces the risk of inducing fibrillation.

7 Claims, 2 Drawing Sheets

INCAPACITATION DEVICE AND METHOD WITH ASYNCHRONOUS T-WAVE AVOIDANCE

BACKGROUND OF THE INVENTION

The invention relates to electric incapacitation devices (EID) such as stun guns and the like and, more specifically, to controlling the lethality of such weapons.

BACKGROUND INFORMATION

Handheld stun-guns are widely used by police officers to subdue uncooperative or potentially dangerous individuals by subjecting them to electric current pulses inducing incapacitating muscle cramps. The jolt from a stun gun is intended to cause such severe cramping as to prohibit locomotion and to cause the victim to fall to the ground.

An approach to tailoring the energy delivery sequence of a stun gun is taught by the inventor in his U.S. Pat. No. 7,778,005, the entire disclosure of which is herein incorporated by reference.

A continuing concern in the design and development of stun guns and the like is achieving an optimum tradeoff between effectiveness and risk. Effectiveness on hardy, robust, or drugged individuals calls for higher power levels. Minimizing a potentially fatal risk of cardiac fibrillation, especially when targeting an individual who has underlying cardiac health issues or who is under severe physical stress, calls for lower power levels.

Fibrillation is most likely to occur if an electric shock pulse is delivered during the T-wave portion of the heart's characteristic QRST waveform. Analysis of typical QRST electrocardiogram (ECG) waves indicate that the susceptible T-wave duration has a duration of about 40 msec to 60 msec. out of a total period of 0.5 sec to 1 second (i.e., for a 60 to 120 beat per minute heart rate).

To assure incapacitation, electric pulse rates are commonly chosen to be high enough to achieve muscle tetanization. Published data has shown that when a regular chain of pulses is applied, pulse rates higher than about 15 Hz are needed to assure complete muscle tetanus. A conventional stun gun satisfies this constraint by supplying about 18 pulses per second (i.e., one pulse every 55 msec). Thus, during a stun application, the probability of each pulse occurring within a susceptible T-wave interval is nearly 100%. This leads to a design strategy of limiting pulse amplitudes to be low enough to be acceptably safe for susceptible individuals and thus sometimes be inadequate for controlling the most difficult individuals.

U.S. Pat. Nos. 6,898,887 and 7,305,787, the disclosures of which are herein incorporated by reference, teach electric incapacitation devices (EID) employing ballistically implanted electrodes to measure a target's ECG waveform before, during or after delivering high voltage pulses. In practice, there is a low probability that an EID's electrodes will make a good enough connection prior to a high voltage pulse to allow for a reliable ECG measurement. Further, even if a good connection is made to the target, the several second delay needed to measure and validate the QRST waveform can be unacceptably long during violent law enforcement confrontations. Virtually instantaneous "take-down" is sought by law enforcement personnel.

Thus, there is a continuing need for increasing the take down effectiveness of an EID while simultaneously decreasing the likelihood of initiating a cardiac fibrillation in a target subject.

BRIEF SUMMARY OF THE INVENTION

One aspect of the invention is that it provides an electric incapacitation device comprising an output pulse control circuit operable to selectively vary time intervals between successive output pulses. The minimum such time interval is at least 55 milliseconds. Other intervals between pulses in a string of output pulses may be longer in order to avoid accidentally synchronizing the string of output pulses to the T-wave portion of a targeted person's ECG waveform.

Another aspect of the invention is that it provides a method of operating an electric incapacitation device asynchronously with a targeted person's cardiac waveform. The method comprises selectively varying time intervals between a plurality of successive output pulses to avoid synchronizing the output pulses with a T-wave portion of an expected cardiac waveform.

Yet another aspect of the invention is that it provides an electric incapacitation device comprising an output pulse control circuit operable to selectively vary both the energy of output pulses and the time intervals between those output pulses. One feature of this control of the power profile is that a constant power can be supplied to a target by increasing the energy of output pulses when the interval between pulses is increased.

Modern EID technology incorporates one or microcomputers to control all major electrical performance parameters such as output pulse width, number of sub-pulses grouped within an overall output pulse, pulse rate and possibly total output voltage amplitude. Thus, unlike older free-running EID technology it is possible to intelligently prescribe the EID output for characteristics which specifically tend to reduce the likelihood that incapacitation pulses will cause a cardiac fibrillation condition to occur irrespective of the target's heart rate, which is considered to stay nearly constant over the typical EID shock delivery period—typically 4 to 5 seconds.

Repeatedly shocking the heart during the T-wave period of the cardiac cycle is believed to cause an accumulative neural disorder leading to a full cardiac fibrillation, even when the individual output shocking pulses are insufficient to cause fibrillation. This is believed to be more likely if the target's physical condition is poor or the cardiovascular system is under great duress due to running, drugs, etc.

EID pulse characteristics can be designed so that the cardiac cycle's T wave interval has a much lower likelihood of encountering repeated EID pulses irrespective of heart rate and phasing. In preferred embodiments of this approach it recognizes that pulse-to-pulse intervals within an EID shock delivery period must be substantially larger than the 55 msec or less that is usually required to achieve full muscle tetanization when a constant pulse rate of nominally sub-lethal pulses are delivered. However, if the T wave interval can be largely avoided by the EID pulses, then a substantially larger pulse may be used which can more than compensate for the lack of tetanization.

Those skilled in the art will recognize that the foregoing broad summary description is not intended to list all of the features and advantages of the invention. Both the underlying ideas and the specific embodiments disclosed in the following Detailed Description may serve as a basis for alternate arrangements for carrying out the purposes of the present invention and such equivalent constructions are within the spirit and scope of the invention in its broadest form. Moreover, different embodiments of the invention may provide various combinations of the recited features and advantages of the invention, and that less than all of the recited features and advantages may be provided by some embodiments.

DETAILED DESCRIPTION OF A PREFERRED EMBODIMENT

In studying this Detailed Description, the reader may be aided by noting definitions of certain words and phrases used throughout this patent document. Wherever those definitions are provided, those of ordinary skill in the art should understand that in many, if not most, instances such definitions apply both to preceding and following uses of such defined words and phrases.

At the outset, it should be noted that the term "output pulse" refers to a high voltage signal delivered to a target with a frequency that is commonly more than 5 per second and generally less than 30 per second. In this context an output pulse may be a single pulse generated by a single switching event (e.g., as occurs in prior art stun guns in which a capacitor is discharged when a gas discharge tube breaks down). An output pulse may also comprise a plurality of sub-pulses generated by multiple closures of a fast electronic switch.

Another term to be considered is 'interval average power", which describes the power delivered by output pulses averaged over the time interval between pulses. In situations in which the output pulse varies, the interval average power for a single interval is defined as the energy of a pulse preceding the interval divided by length of the subsequent time interval.

Figure 1:
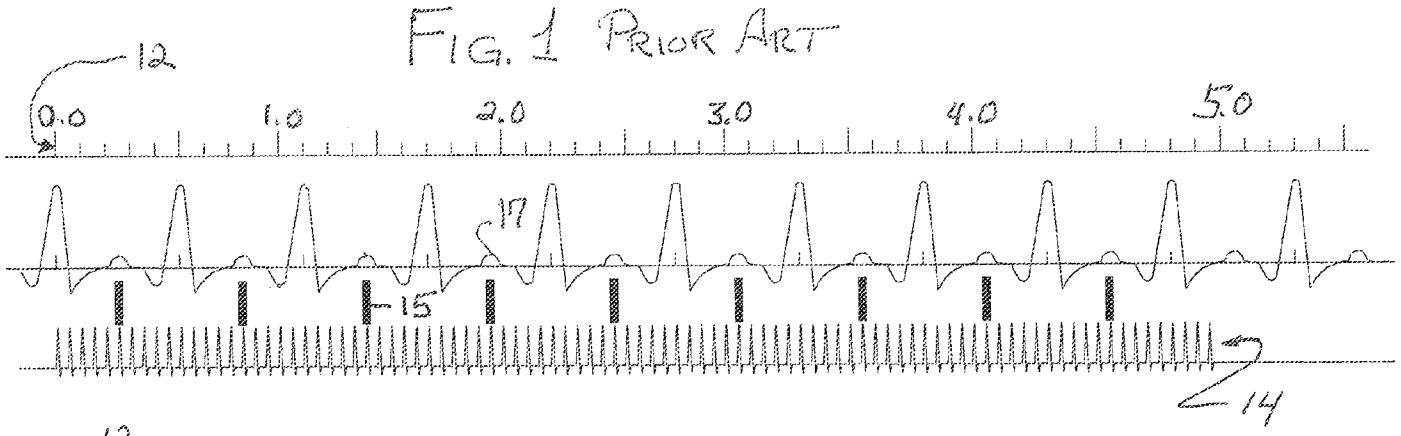
FIG. 1 PRIOR ART
FIG. 1 is a schematic comparison of a 120 beat per minute ECG waveform and a sequence of shocking pulses delivered at a fixed rate of 18 pulses per second, the comparison showing overlap between shocking pulses and a T-wave portion of the ECG signal.

Turning now to FIG. 1, one finds a depiction of an ECG signal 10 associated with a hypothetical fleeing subject. A comparison with the time line 12 indicates that for this example the subject's heart rate is 120 beats per minute. Adjacent this ECG signal is a sequence of EID output pulses 14 delivered at a constant output rate of 18 pulses per second (pps). A set of black vertical bars 15 is used to show coincidence between T-wave portions 17 of the ECG and output pulses. Note that essentially 100% of the depicted T-wave intervals 17 occur simultaneously with output pulses falling well within a 40 msec "window" of the very susceptible T wave interval. This continuous, constant-rate pulsing of the T-wave interval encourages fibrillation in an already stressed heart.

The present invention reduces the probability of T-wave overlay by various combinations of applying larger output pulses at lower rates and varying output pulse rates during an overall EID shocking period. The output pulsing rates are not synchronized to a target's ECG, but are selected in a manner that, based on a reasonably expected range of heart rates, is expected to yield output pulses asynchronous to the target's ECG signal. All such output pulsing control methods that operate without foreknowledge of the target's ECG and that demonstrate a high probability of avoiding output pulses coinciding with a T-wave portion of the ECG are hereinafter referred to as "probabilistic methods' and the related time interval selections are referred to as "probabilistic selections".

Figure 2:
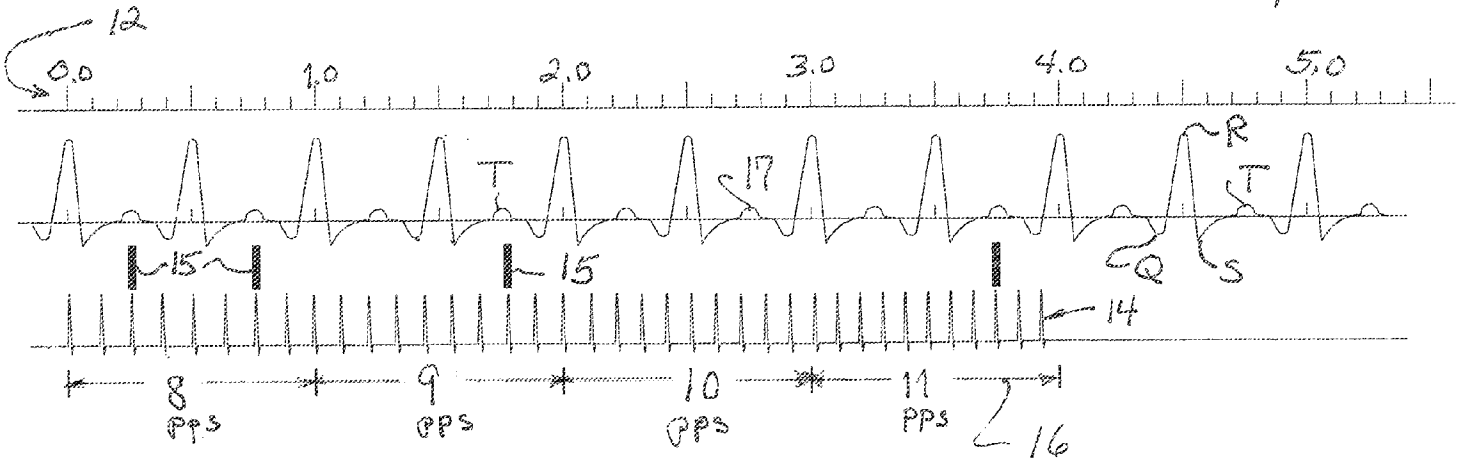
FIG. 2 is a schematic comparison of a 120 beat per minute ECG waveform and a sequence of shocking pulses delivered at variable rates of 8, 9, and 11 pulses per second, the comparison showing a substantial reduction of overlap between shocking pulses and a T-wave portion of the ECG signal.

Turning now to FIG. 2, one finds a depiction of the result of using four moderately different EID probabilistically selected output pulse rates (8, 9, 10 and 11 pps) during sequential one second periods 16 in an overall EID take-down attempt on a subject having the same heart rate as was used in FIG. 1. In this example the first set of output pulses nearly exactly overlays sequential T-waves 17, as shown by the black coincidence bars 15. However, the subsequent different shock-pulse rates yield a much lower chance of pulse placement within the T-wave interval. Thus, by varying the EID pulse rate modest amounts over a take-down attempt the likelihood of exactly overlaying the T-wave interval for a substantial percentage of the shocking period is dramatically lower for any given heart rate.

The skilled reader will appreciate that there are many techniques for probabilistically varying intervals between output pulses to yield an asynchronous result. A preferred embodiment uses a sequence of pulse rates, each of which is relatively prime to preceding and following pulse rates, as depicted in FIG. 2. In another embodiment that places a higher computational demand on a controller, the pulse rates are varied in a pseudo-random fashion between high rate and low rate limits.

Further, there are important safety and performance advantages to also adjusting each shock pulse's energy dynamically as the interval between pulses is varied. For instance, if the pulse rate is low, say 8.5 pps, then we may wish to increase the pulse energy relative to the 11 pps rate such that the total power output on a pulse to pulse basis is essentially constant. This constant interval average power profile attempts to maintain a more or less constant muscle incapacitation capability in spite of the differing pulse to pulse time spacing.

Similarly, the EID designer may wish to select a profile in which pulse to pulse power is reduced as the shocking period progresses. This selection might be made, for instance, if the target is a small animal or person. Thus, in general, we wish to vary not only the pulse to pulse period over the shocking period to avoid T-wave coincidence but also to vary each pulse's energy to accomplish a specific result.

Figure 3:
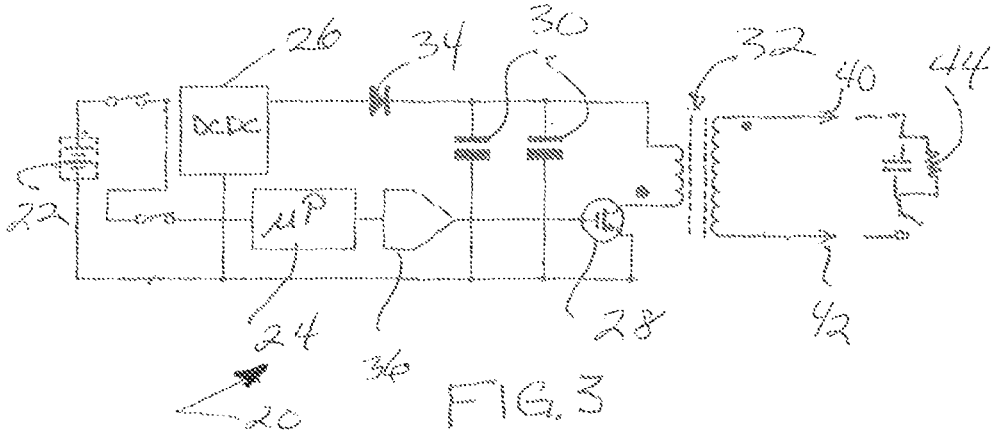
FIG. 3 is a schematic diagram of an exemplar circuit usable to generate the sequence of output pulses shown in FIG. 2.
Figure 4:
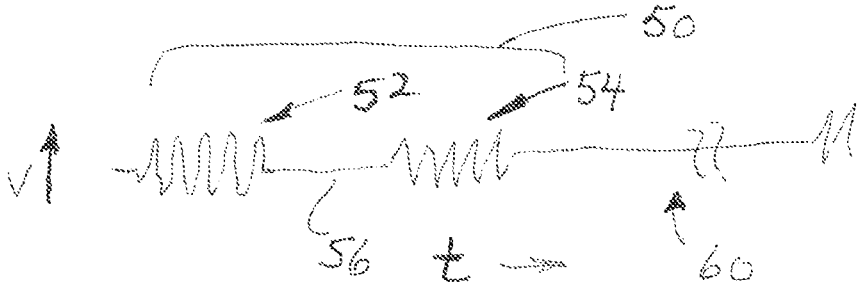
FIG. 4 is a schematic depiction of an output pulse of an exemplar EID

Turning now to FIG. 3, one finds a schematic depiction of the power electronics portion 20 of an EID operable to provide T-wave asynchronous shocking. The battery pack 22 powers a controller 24 and a high voltage DC-DC supply 26. When the device is triggered, the controller 24 controls the DC supply 26 and a controllable semiconductor switch 28 to charge a capacitor or capacitor bank 30 and to send current pulses through the primary winding of a step-up transformer 32.

In a particular preferred embodiment, the power electronics portion of the stun gun is controlled by a microcontroller 24, such as a Model 16F687 made by the Microchip Corporation. Those skilled in the control arts will recognize that although this arrangement is preferred, there are many other approaches that can be used to provide the necessary control features. These include, but are not limited to the use of other controllers as well as of hard-wired or custom programmed logic elements well known in the art.

The high voltage DC supply 26 is preferably any of many well-known step up, switching-type DC-DC power supply circuits with a delivered power rating in the 10 watt to 20 watt range. When active, the preferred high voltage DC supply provides an output voltage of approximately 100 VDC.

Current from the high voltage DC supply 26 passes through a diode 34 to charge a capacitor 30.

A semiconductor switch 28, which is preferably an insulated gate bipolar transistor (IGBT), Model IRG4PH50 KDP, supplied by the International Rectifier company, is controlled through a driver 36 by the controller 24 to discharge the capacitor 30 through the primary winding of the transformer 32. Although this element is depicted in FIG. 3 as being physically connected between the transformer and negative rail, those skilled in the art will recognize that the semiconductor switch 32 can be located at other positions in the circuitry.

The preferred IGBT 28 can be controlled to generate pulses of a controllable width that can be as narrow as one microsecond. It can also be used to generate, as a single output pulse, a long string of such sub-pulses during the course of a single discharge of the capacitor 30.

The circuit schematically depicted in FIG. 3 may be recognized as a flyback circuit that, when operated in pulsed mode, provides a range of voltage outputs depending on the impedance across the output electrodes 40, 42. In one limiting case, one can consider the output electrodes 40, 42 as being separated by a high impedance, such as an air gap. In the other limiting case, a relatively low resistance, provided by tissue of a target 44, is connected between the two output electrodes.

If the output of the step-up transformer is open-circuited and the controllable IGBT switch 28 is suddenly closed, current flows from the high voltage DC power supply 26 and the substantially charged capacitor 30. This current creates a magnetic field in the transformer inductance. If the controllable switch 28 is then abruptly opened, the magnetic field collapses and induces a large 'flyback' voltage spike across the pairs of electrodes. In a particular preferred embodiment, using the circuit components described above, flyback voltage spikes of 55-65 kV were produced.

In a preferred embodiment, during a time period in which a low impedance situation is believed to persist (e.g., after an initial high spark energy period of approximately 0.1 to 0.25 sec), the controller is programmed to generate an output pulse 50 comprising a plurality of sub-pulses 52, 54. This is done by opening and closing the switch 28 in rapid succession. In a particular preferred embodiment, the output pulse comprises two groups of sub-pulses. The first sub-pulse group 52 of five to fifteen sub-pulses spans a period of 300 to 400 μsec. This is followed, after a pause 56 of about 100 msec by a second group 54 of five to fifteen pulses. The second group is followed by a time interval 60 selected for T-wave asynchronous shocking.

A series of tests were made of incapacitation effects while keeping the total power delivered approximately constant. Rates of 20 pps were compared to the above listed lower rates. Indeed, the muscular incapacitation effect of the lower rate, higher energy-per pulse was found to be improved relative to a higher pulse rate, lower energy per pulse. Thus, the subject invention is believed to be not only more effective but safer than prior art.

Although the present invention has been described with respect to several preferred embodiments, many modifications and alterations can be made without departing from the invention. Accordingly, it is intended that all such modifications and alterations be considered as being within the spirit and scope of the invention as defined in the attached claims.

The invention claimed is:

1. A method of operating an electric incapacitation device so as to avoid synchronizing a plurality of output pulses generated by the device with a T-wave portion of an expected cardiac waveform of a target of the incapacitation device, the method comprising the steps of:

selecting an expected range of time intervals between the target's heart beats;

probabilistically selecting a plurality of time intervals within the expected range thereof; and applying each of the plurality of output pulses to the target at a respective one of the probabilistically selected time intervals.

2. The method of claim 1 wherein each probabilistically selected time interval has a duration of at least 55 milliseconds.

3. The method of claim 1 wherein each probabilistically selected time interval is selected pseudo-randomly.

4. The method of claim 1 wherein a first subset of the plurality of output pulses is associated with a first probabilistically selected time interval and an immediately subsequent second subset of the plurality of output pulses is associated with a second probabilistically selected time interval relatively prime to the first probabilistically selected time interval.

5. The method of claim 1 wherein a respective energy of each output pulse is selected responsive to the duration of the associated selected time interval to yield a selected value of an interval average power.

6. The method of claim 1 wherein a respective energy of each output pulse is selected so that a respective interval average power increases monotonically with time.

7. The method of claim 1 wherein a respective energy of each output pulse is selected so that a respective interval average power decreases monotonically with time.

* * * * *